US012560040B2

(12) United States Patent
Nguyen et al.

(10) Patent No.: US 12,560,040 B2
(45) Date of Patent: Feb. 24, 2026

(54) ONE TRIP CEMENT PLUGGING AND MILLING/DRILLING SIDETRACK ASSEMBLY, METHOD, AND WELLBORE SYSTEM

(71) Applicant: Baker Hughes Oilfield Operations LLC, Houston, TX (US)

(72) Inventors: Tuan Nguyen, Pearland, TX (US); James Scott Trahan, Magnolia, TX (US)

( * ) Notice: Subject to any disclaimer, the term of this patent is extended or adjusted under 35 U.S.C. 154(b) by 0 days.

(21) Appl. No.: 18/485,774

(22) Filed: Oct. 12, 2023

(65) Prior Publication Data

US 2025/0122773 A1 Apr. 17, 2025

(51) Int. Cl.

| | |
|---|---|
| ***E21B 29/06*** | (2006.01) |
| ***E21B 17/06*** | (2006.01) |
| ***E21B 33/13*** | (2006.01) |

(52) U.S. Cl.

CPC ..... *E21B 29/06* (2013.01); *E21B 17/06* (2013.01); *E21B 33/13* (2013.01)

(58) Field of Classification Search

CPC ..... E21B 29/06; E21B 17/06; E21B 33/13; C09K 8/426

See application file for complete search history.

(56) References Cited

U.S. PATENT DOCUMENTS

| | | | | |
|---|---|---|---|---|
| 7,225,889 | B2 | 6/2007 | Dewey | |
| 11,414,943 | B2 | 8/2022 | Nguyen et al. | |
| 2014/0338908 | A1* | 11/2014 | Ervin | E21B 17/042 166/113 |
| 2020/0291748 | A1* | 9/2020 | Ali | E21B 23/0411 |
| 2021/0054708 | A1* | 2/2021 | Al-Mousa | E21B 33/134 |

* cited by examiner

*Primary Examiner* — Crystal J Lee

(74) *Attorney, Agent, or Firm* — Baker Hughes Company

(57) ABSTRACT

A one trip cement plugging and milling/drilling sidetrack assembly, including a whipstock having a cement flow bore therethrough, a milling/drilling system having a cement flow bore therethrough attached to the whipstock, and a cement flow adapter conduit connecting the flow bore in the milling/drilling system with the flow bore in the whipstock. A method for cement plugging and milling/drilling a sidetrack in one trip, including flowing cement through a mill/drill, through an adapter conduit and through a whipstock connected to the mill/drill, creating a cement plug with the cement, setting an anchor connected to the whipstock, and drilling a sidetrack. A wellbore system, including a borehole in a subsurface formation, a string in the borehole, and a one trip cement plugging and milling/drilling sidetrack assembly disposed within or as a part of the string.

9 Claims, 7 Drawing Sheets

ONE TRIP CEMENT PLUGGING AND MILLING/DRILLING SIDETRACK ASSEMBLY, METHOD, AND WELLBORE SYSTEM

BACKGROUND

In the resource recovery and fluid sequestration industries cement plugging and drilling sidetrack boreholes is a common activity. Myriad needs require this type of action. Unfortunately, three runs are required to accomplish this action. Runs are expensive and time consuming. Therefore, the art would well receive alternative apparatus and methods that can accomplish the desired result without the excessive number of runs.

SUMMARY

An embodiment of a one trip cement plugging and milling/drilling sidetrack assembly, including a whipstock having a cement flow bore therethrough, a milling/drilling system having a cement flow bore therethrough attached to the whipstock, and a cement flow adapter conduit connecting the flow bore in the milling/drilling system with the flow bore in the whipstock.

An embodiment of a method for cement plugging and milling/drilling a sidetrack in one trip, including flowing cement through a mill/drill, through an adapter conduit and through a whipstock connected to the mill/drill, creating a cement plug with the cement, setting an anchor connected to the whipstock, and drilling a sidetrack.

An embodiment of a wellbore system, including a borehole in a subsurface formation, a string in the borehole, and a one trip cement plugging and milling/drilling sidetrack assembly disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
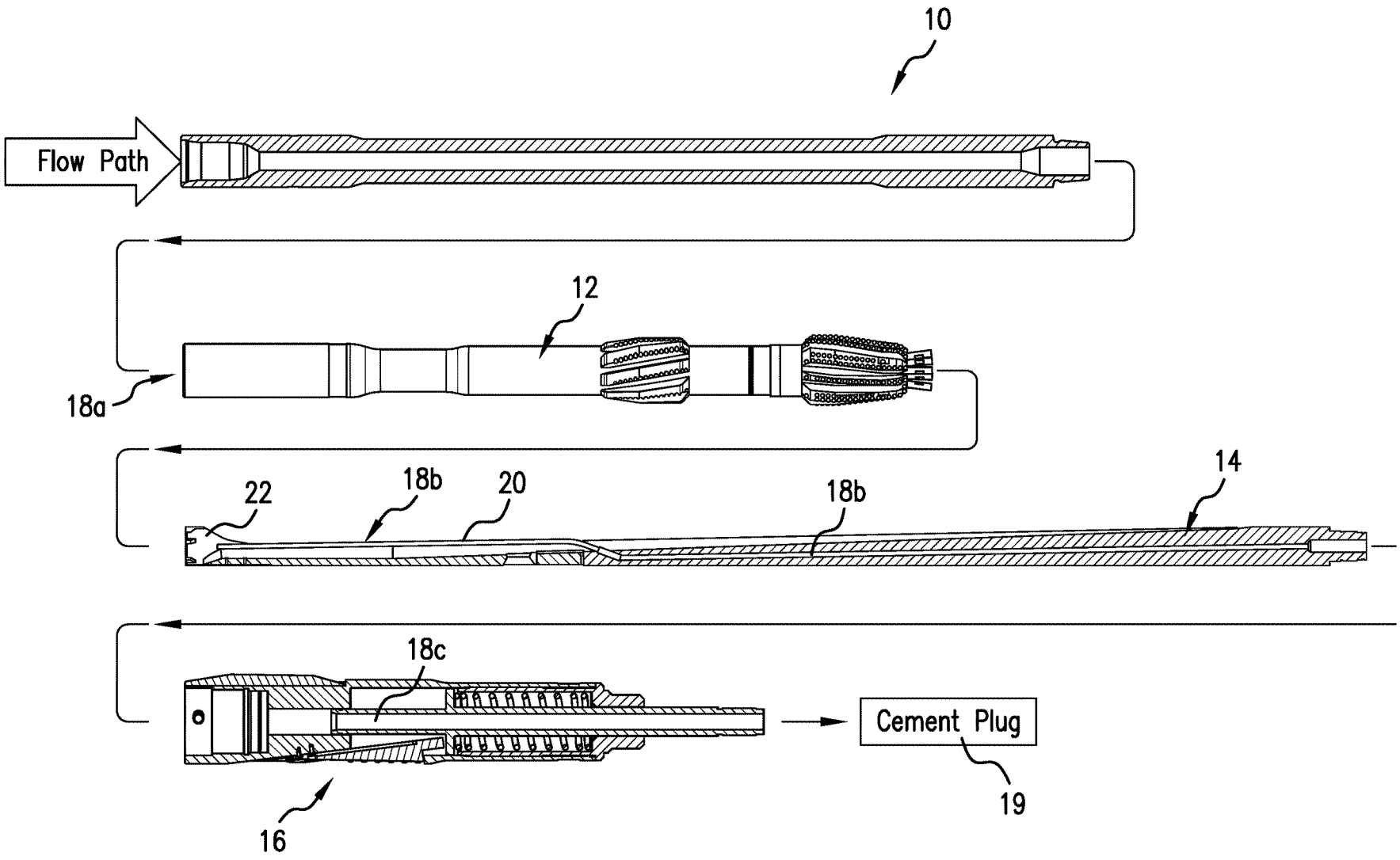
FIG. 1 is an extended partial sectional view of one trip cement plugging and milling/drilling sidetrack assembly as disclosed herein.
Figure 2:
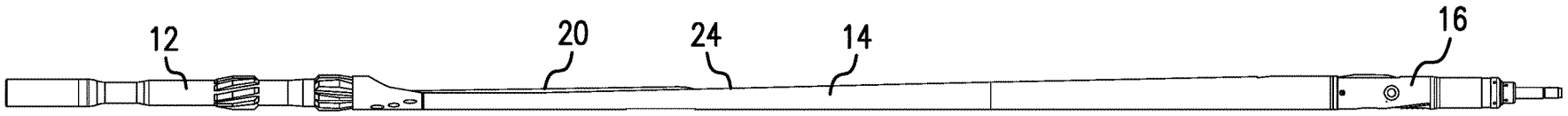
FIG. 2 is a side view of the assembly of FIG. 1, in assembled form.
Figure 3:
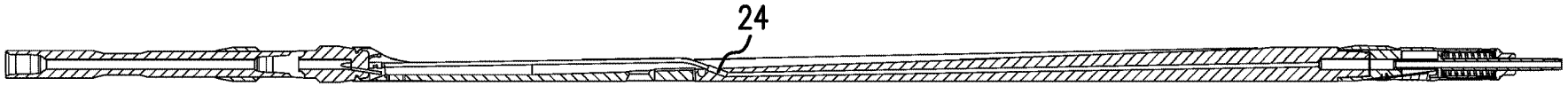
FIG. 3 is a sectional side view of FIG. 2.

Referring to FIGS. 1-3, a one trip cement plugging and milling/drilling sidetrack assembly 10 is illustrated (in an extended form in FIG. 1, so that more detail may be illustrated on a single drawing sheet). Assembly 10 includes a mill/drill section 12, a whipstock 14, and an anchor section 16. Each of these sections is secured together in the order illustrated. When assembled, the assembly 10 provides for a flow path 18 through the assembly 10 that includes an adapter conduit 20 near an uphole end 22 of the whipstock 14. The conduit 20 completes the path 18 that is otherwise internal to the components 12, 14, 16 of assembly 10. Flow path 18 exists in each one of the sections 12, 14, and 16 and is labeled as 18*a*, 18*b*, and 18*c* for clarity. The adapter conduit 20 connects path 18*a* and 18*b* but passes along a face 24 of the whipstock 14. With the complete flow path 18, cement may be deployed through assembly 10 to create a cement plug in a borehole in which the assembly is disposed. Due to the construction of assembly 10 the benefit of a single run that facilitates cement plugging and side track drilling is achieved.

During use, the assembly is run to depth and cement is flowed through path 18 to create a cement plug 19 immediately downhole of the assembly 10. The assembly 10 is then lifted and circulation is used to displace cement from the assembly 10. At this point the operator is free to decide exactly where it is desired to place the kick of point (KOP). It may be actually in the cement plug (set prior to curing), right above the cement plug or spaced from the cement plug as desired. This is another of the benefits of the assembly 10 as prior art configurations that require multiple trips cannot provide all of these options.

Figure 4:
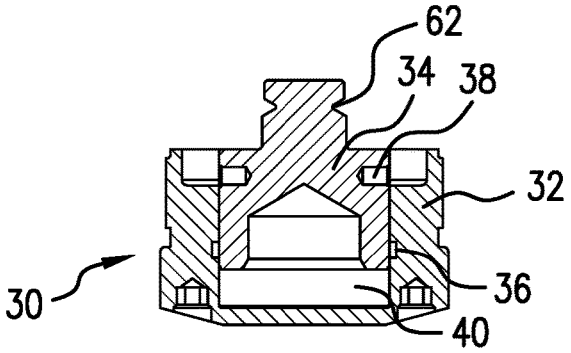
FIG. 4 is a sectional view of an interference piston as disclosed herein.
Figure 5:
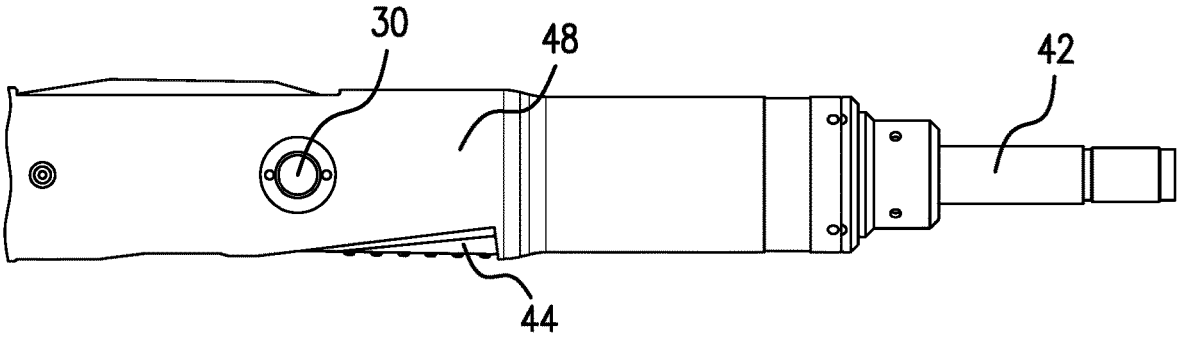
FIG. 5 is an enlarged view of an anchor section of the assembly of FIG. 2.
Figure 6:
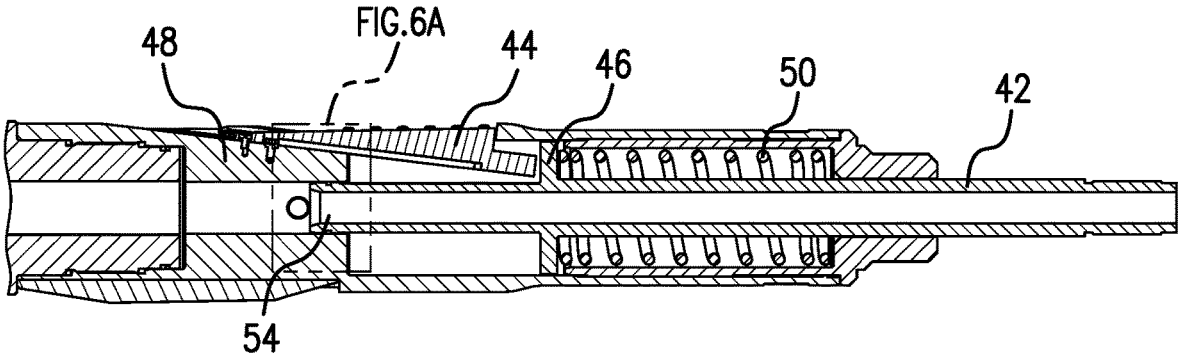
FIG. 6 is a sectional view of FIG. 5 in a run in position.
Figure 6A:
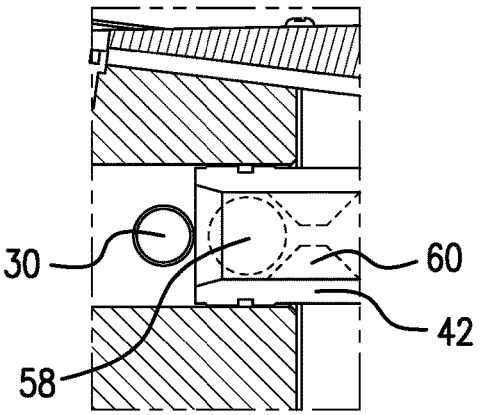
FIG. 6A is an enlarged view of a portion of FIG. 6 to show an alternate pressure up construction.
Figure 7:
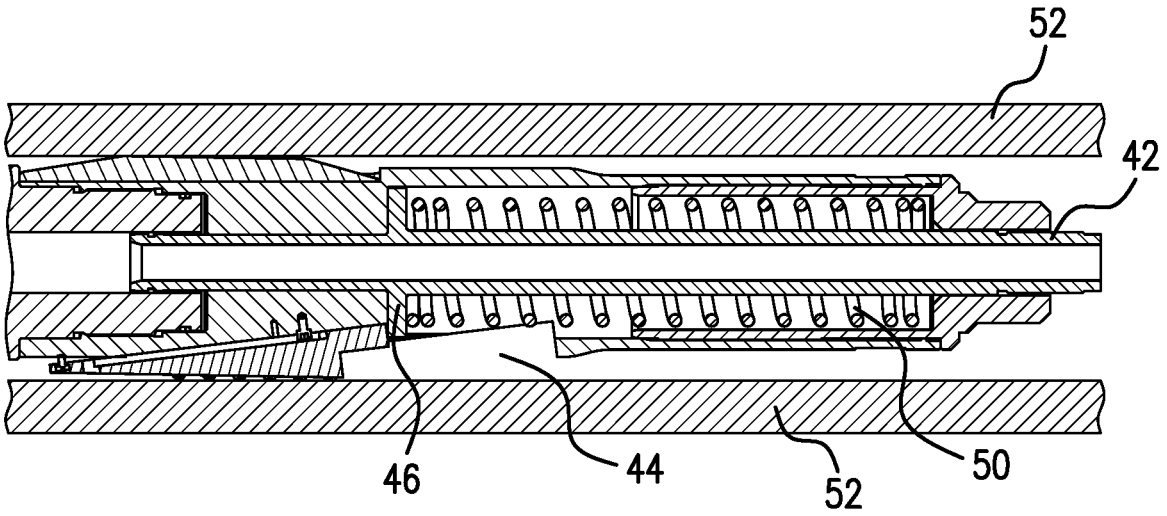
FIG. 7 is a sectional view of FIG. 5 in a set position.

Once a desired KOP is selected, the assembly, and specifically the whipstock face, may be oriented using known systems such as Universal Bottom Hole Orientation or Measurement While Drilling systems to select the desired kick off azimuth. Once oriented, the anchor 16 may be set. Setting of the anchor may be accomplished through the application of tubing pressure (with or without a landed object), annulus pressure, or mechanically. Referring to FIG. 4, an anchor activation module 30 is illustrated in cross section. Module 30 is illustrated in position in anchor 16 in FIG. 5 (and can also be seen in FIGS. 1 and 2, though small). Module 30 includes a housing 32 and an interference piston 34 disposed therein. The piston 34 is sealed to the housing 32 at seal 36 and retained in the position illustrated in FIG. 4 by a releaser 38. Defined between the housing 32 and the piston 34 is a lower pressure chamber 40, which may be an atmospheric chamber. "lower" simply means at a pressure that is less than pressure that might be applied via the tubing or the annulus. Obviously, the lower the pressure actually contained in the chamber 40, the less pressure is needed in the tubing or annulus to effect actuation of the anchor. Upon a differential pressure being presented across seal 36, the piston 34 will be loaded into the chamber 40. When the applied load meets a threshold load for release of the releaser 38, the releaser will release and the piston 34 will move into the chamber 40 thereby becoming a lower profile and no longer acting as an impediment to the actuation of the anchor 16. It will be appreciated from FIG. 6 that the module 30 prevents mandrel 42 from moving uphole to actuate a slip 44 with plate 46 until the piston 34 is moved into the chamber 40. Once piston 34 is moved, mechanical load on the mandrel 42, whether from a power spring 50 of from set down weight on the cement plug 19 will cause the slip 44 to move radially outwardly of a housing 48 of the anchor 16 to engage a casing/formation 52 (see FIG. 7). If annulus pressure is to be used, a blowout preventer (not shown)

would be closed so that annulus pressure may be raised. If tubing pressure is to be used, there are two methods contemplated for this pressure to be applied. One is to simply increase flow rate so that flow through the mandrel 42 causes a backpressure at the entrance 54 thereto. Alternatively, an object 58 may be landed on a seat 60 both illustrated in dashed lines in FIG. 6A to illustrate optionality. If the object method is used, the seat 60 will be a defeatible seat (shear out, dissolvable, shiftable, etc.) so that it does not present an impediment to other well operations later. If annulus pressure or tubing pressure are not desired or not available, the anchor 16 may still be set purely mechanically. As may be appreciated from FIG. 4, the piston 34 may be equipped with a reduced strength section 62 that may be a narrowed section as shown or simply may be created via a weaker material. Further, it is to be understood that a reduced strength section 62 is not required since the piston 34 can be sheared by a bit higher load without any particular feature designed to reduce the required load. After the slip 44 is put into contact with the casing/formation 52, set down weight will effect final anchor setting.

Figure 8:
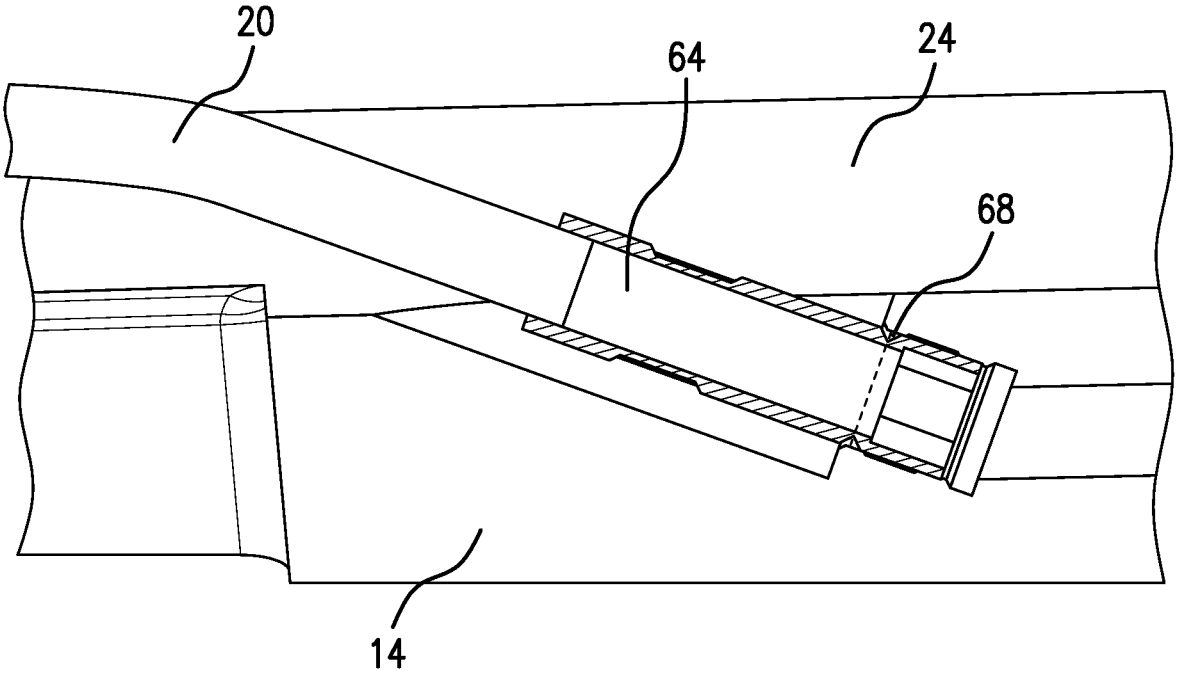
FIG. 8 is an enlarged view of a breakaway as disclosed herein.

With the anchor 16 set, rotational torque applied to the mill/drill 12 will release the mill/drill from the whipstock 14 and a mill drill operation may begin. The adapter conduit 20 is still disposed on the whipstock face 24 at this point but is easily removed by the mill/drill section 12 or may be made easier to remove by a breakaway 64 that is fluidly connected to the adapter conduit 20 and disposed in the whipstock face 24. An enlarged view of the breakaway is illustrated in FIG. 8 for clarity. The breakaway is configured, in some embodiments, with a reduced strength section 68 to easy the parting of breakaway 64 beneath the face 24 of the whipstock.

Figure 9:
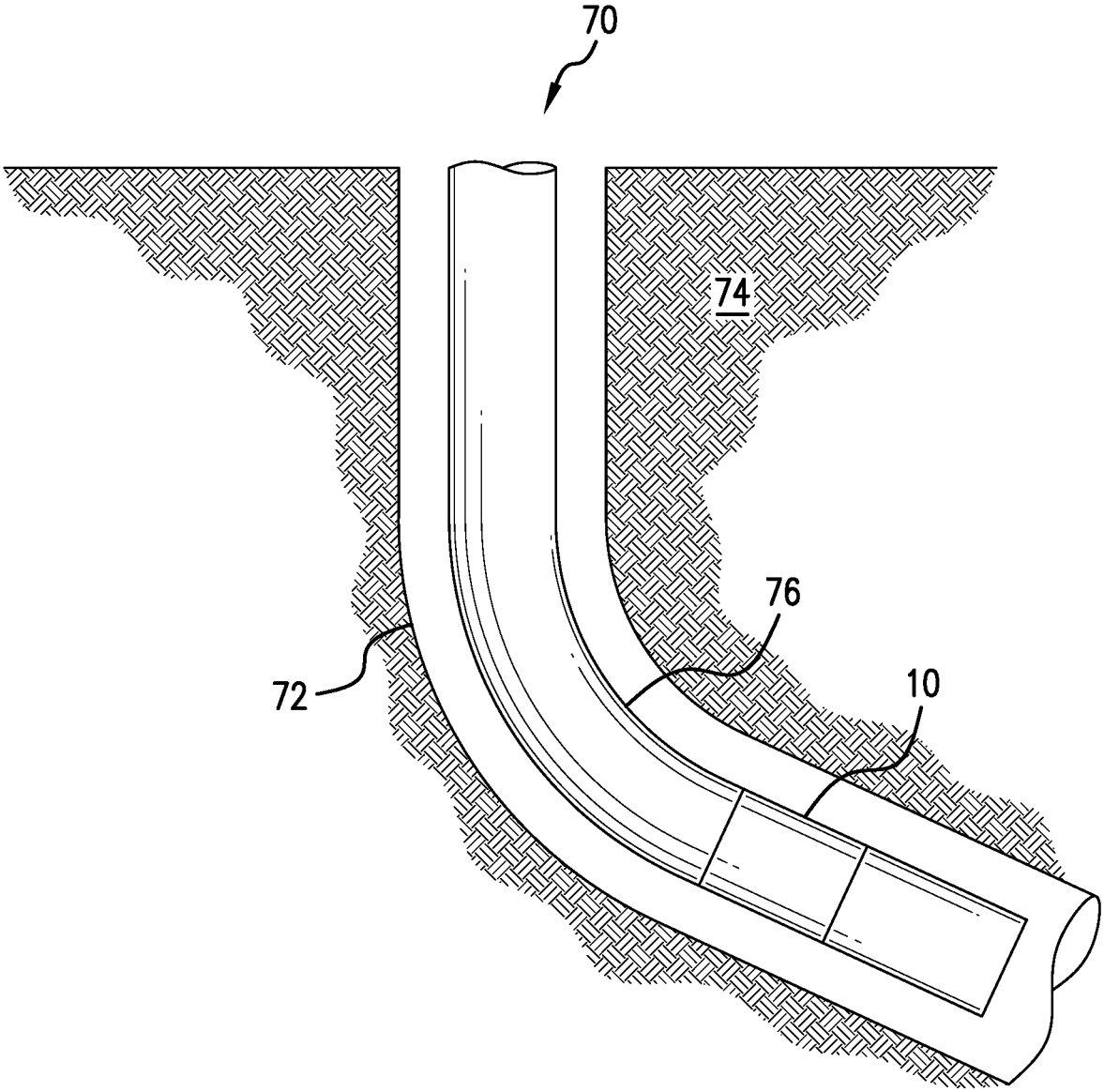
FIG. 9 is a view of a borehole system including the assembly as disclosed herein.

Referring to FIG. 9, a borehole system 70 is illustrated. The system 70 comprises a borehole 72 in a subsurface formation 74. A string 76 is disposed within the borehole 72. An assembly 10 as disclosed herein is disposed within or as a part of the string 76.

Set forth below are some embodiments of the foregoing disclosure:

Embodiment 1: A one trip cement plugging and milling/drilling sidetrack assembly, including a whipstock having a cement flow bore therethrough, a milling/drilling system having a cement flow bore therethrough attached to the whipstock, and a cement flow adapter conduit connecting the flow bore in the milling/drilling system with the flow bore in the whipstock.

Embodiment 2: The system as in any prior embodiment, wherein the adapter conduit is disposed on a face of the whipstock.

Embodiment 3: The system as in any prior embodiment, wherein the adapter conduit includes a conduit breakaway in the whipstock.

Embodiment 4: A method for cement plugging and milling/drilling a sidetrack in one trip, including flowing cement through a mill/drill, through an adapter conduit and through a whipstock connected to the mill/drill, creating a cement plug with the cement, setting an anchor connected to the whipstock, and drilling a sidetrack.

Embodiment 5: The method as in any prior embodiment, wherein the releasing includes application of tubing pressure.

Embodiment 6: The method as in any prior embodiment, wherein the releasing includes application of annulus pressure.

Embodiment 7: The method as in any prior embodiment, wherein the releasing includes application a shear load to a releaser.

Embodiment 8: The method as in any prior embodiment, further including separating the mill/drill from the whipstock.

Embodiment 9: The method as in any prior embodiment, wherein the separating further includes breaking away the adapter conduit from the whipstock.

Embodiment 10: The method as in any prior embodiment, wherein the setting is in the plug.

Embodiment 11: The method as in any prior embodiment, wherein the setting is uphole of the plug.

Embodiment 12: The method as in any prior embodiment, further including breaking away an adapter conduit breakaway thereby releasing the adaptor conduit from the whipstock.

Embodiment 13: A wellbore system, including a borehole in a subsurface formation, a string in the borehole, and a one trip cement plugging and milling/drilling sidetrack assembly disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method for cement plugging and milling/drilling a sidetrack in one trip, comprising:

flowing cement through a mill/drill, through an adapter conduit and through a whipstock connected to the mill/drill;

creating a cement plug with the cement, wherein the method requires the ability to select a kickoff point that is among three options: 1) in the cement plug while uncured, 2) immediately uphole of the cement plug, or 3) spaced from the cement plug;

after creating the cement plug:

considering all three of the options, and then selecting the kickoff point from the three options;

setting an anchor connected to the whipstock at the selected kickoff point; and drilling a sidetrack.

2. The method as claimed in claim 1, further including releasing a releaser initially impeding setting of the anchor, the releasing including application of tubing pressure.

3. The method as claimed in claim 2, wherein the releasing includes application of a shear load to the releaser.

4. The method as claimed in claim 1, further including releasing a releaser initially impeding setting of the anchor, the releasing including application of annulus pressure.

5. The method as claimed in claim 1, further including separating the mill/drill from the whipstock.

6. The method as claimed in claim 5, wherein the separating further includes breaking away the adapter conduit from the whipstock.

7. The method as claimed in claim 1, wherein the setting is in the cement plug.

8. The method as claimed in claim 1, wherein the setting is uphole of the cement plug.

9. The method as claimed in claim 1, further including breaking away an adapter conduit breakaway thereby releasing the adaptor conduit from the whipstock.

* * * * *